US006056561A

United States Patent [19]

Lin

[11] Patent Number: 6,056,561

[45] Date of Patent: May 2, 2000

[54] ADAPTER AND TRACK ARRANGEMENT FOR LIGHTING FIXTURES

[76] Inventor: Shan Chaing Lin, No. 2, Lane 111, Ta Chu Road, Lu Chu, Hsiang, Taoyuan Hsien, Taiwan

[21] Appl. No.: 09/247,215

[22] Filed: Feb. 8, 1999

[51] Int. Cl.[7] ..... H01R 25/00

[52] U.S. Cl. ..... 439/121

[58] Field of Search ..... 439/117, 118, 439/119, 120, 121, 122

[56] References Cited

U.S. PATENT DOCUMENTS 3,686,614 8/1972 Hyrylainen ..... 439/122
5,334,037 8/1994 Gabrius et al. ..... 439/118

*Primary Examiner*—Michael L. Gellner
*Assistant Examiner*—Antoine Ngandjui
*Attorney, Agent, or Firm*—Dougherty & Troxell

[57] ABSTRACT

An adapter and track arrangement in which the track includes a metal casing, an insulator strip mounted inside the casing and having two opposed inside flanges, and two metal conducting strips bilaterally mounted within the insulator strip between the inside flanges and flat top wall of the insulator strip; the adapter includes a first shell, a second shell covered on the first shell to hold electric wires and electric contacts at the ends of the electric wires, a third shell covered on the second shell, and a latch mounted in the third shell and operated to lock the adapter, the latch having two spring arms, which are deformed when the latch is forced down to unlock the adapter, or automatically return to their former shape to force the latch into the locking position to lock the adapter when the latch is released from the user's hand.

2 Claims, 6 Drawing Sheets

ADAPTER AND TRACK ARRANGEMENT FOR LIGHTING FIXTURES

BACKGROUND OF THE INVENTION

The present invention relates to a track for hanging light fixtures, and relates also to an adapter for a lighting fixture track.

U.S. Pat. No. 5,334,037 discloses an adapter box for a low voltage fixture, in which a latch is vertically movably installed in a latch recess at one housing half of the adapter box. Because the spring arm of the latch is suspended inside the housing half, water may pass through the gap between the latch and the housing half, and an electric shock may occur when the user operates the latch. Because the track uses an insulator body to cover the electric wires, its bending strength is low. When a large number of light fixtures are hung on the track, the track tends to be forced to deform. Further, because the wires used in the track commonly have a circular cross section, the contact area between the wires and the contacts in the adapter is limited, and an erroneous contact may occur.

SUMMARY OF THE INVENTION

The present invention has been accomplished to provide an adapter and track arrangement which eliminates the aforesaid problems. It is one object of the present invention to provide a track for light fixtures which has high bending strength. It is another object of the present invention to provide an adapter and track arrangement which is safe in use. According to one aspect of the present invention, the track comprises an elongated metal casing, an insulator strip mounted within the metal casing, and two metal conducting strips bilaterally mounted within the insulator strip and insulated from the metal casing by the insulator strip, the metal casing comprising a flat top wall, bottom walls separated by a longitudinal gap, and two vertical side walls bilaterally connected between the flat top wall and the bottom walls, the insulator strip having a flat top wall closely attached to the flat top wall of the metal casing on the inside, two vertical side walls respectively closely attached to the vertical side walls of the casing on the inside, and two inside flanges respectively perpendicularly raised from the vertical side walls of the insulator strip toward each other and respectively spaced between the flat top wall and bottom walls of the metal casing, the inside flanges of the insulator strip defining with the bottom walls of the metal casing a positioning space, the metal conducting strips being bilaterally inserted into the insulator strip within the metal casing and respectively retained between the flat top wall and inside flanges of the insulator strip. According to another aspect of the present invention, the adapter comprises a third shell securely covered on the second shell at one side opposite to the first shell, the third shell comprising a recessed receiving chamber, a top notch, and a back opening, and a latch received in the recessed receiving chamber in the third shell, the latch comprising a body received in the recessed receiving chamber in the third shell, a stop flange raised from the body at a top side and suspended in the top notch outside the third shell, two spring arms at two opposite sides, a press knob formed integral with the body at a bottom side and extended out of the third shell through the back opening at the third shell for operation by hand to move the stop flange into the gap at the track enabling the adapter to be locked after the coupling block of the adapter has been inserted into the gap at the track and rotated through 90° angle to force the contacts of the adapter into contact with the metal conducting strips in the track.

DETAILED DESCRIPTION OF THE PREFERRED EMBODIMENT

Figure 1:
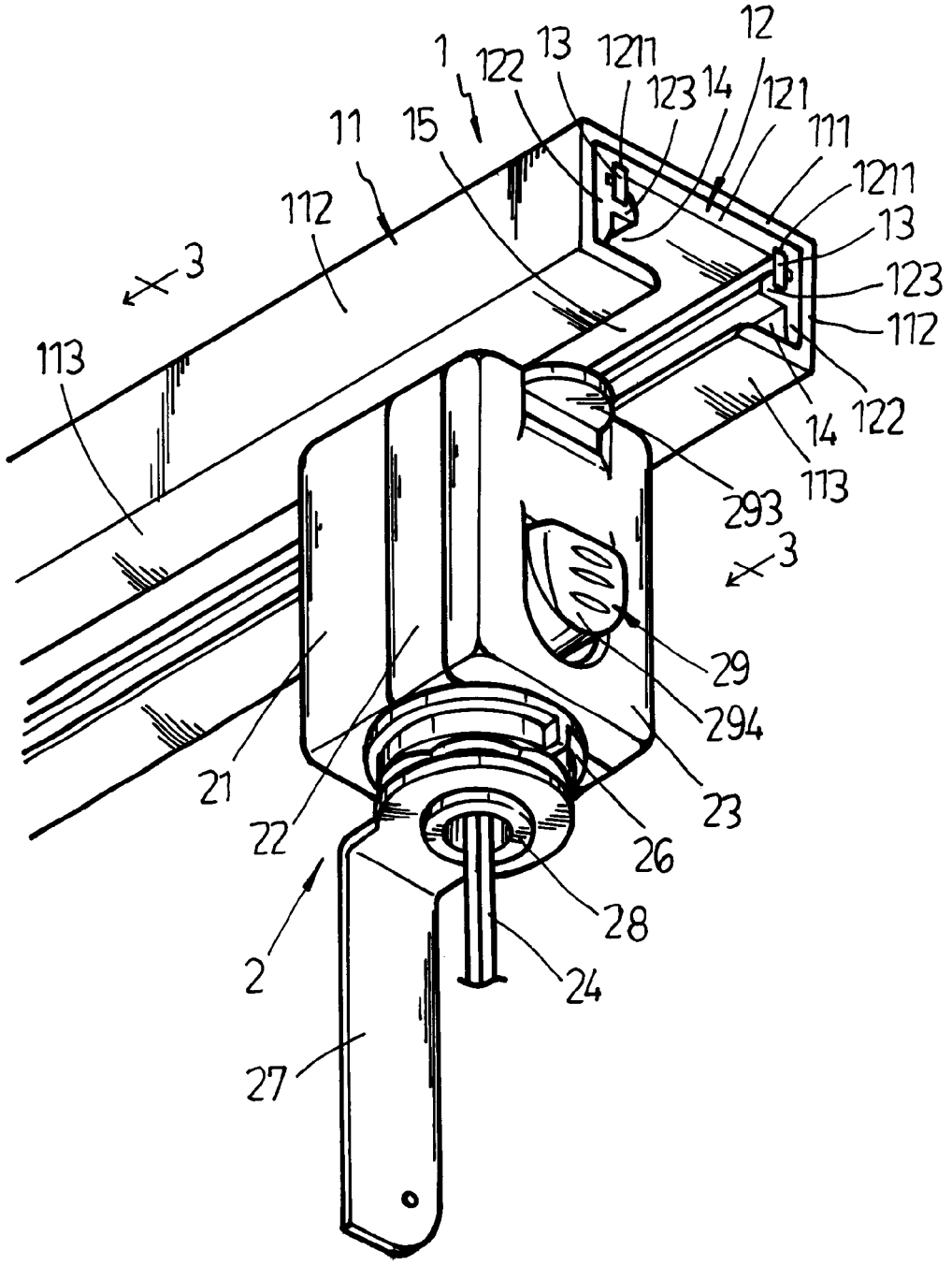
FIG. 1 is a perspective view of an adapter and track arrangement according to the present invention.

Referring to FIGS. from 1 through 3, an adapter and track arrangement according to the present invention comprises track 1, and an adapter 2 hung on and moved along the track 1. The adapter 2 comprises a bracket 27 for hanging lighting fixtures, and a latch 29, which is operated to lock/unlock the connection between the track 1 and the adapter 2.

Referring to FIGS. from 1 through 3 again, the track 1 comprises an elongated metal casing 11, an insulator strip 12, and two metal conducting strips 13. The metal casing 11 comprises a flap top wall 111, two vertical side walls 112 perpendiculary downwardly extended along two opposite lateral sides of the flat top wall 111, and two bottom walls 113 perpendicularly inwardly extended from the side walls 112 at a bottom side toward each other and spaced from each other by a gap 15 and arranged in parallel to the flat top wall 111. The insulator strip 12 is inserted into the casing 11, having a flat top wall 121 closely attached to the flat top wall 111 of the casing 11 on the inside, two vertical side walls 122 respectively closely attached to the vertical side walls 112 of the casing 11 on the inside, and two inside flanges 123 respectively perpendicularly raised from the vertical side walls 122 toward each other and respectively spaced between the flat top wall 111 and bottom walls 113 of the casing 11. After installation of the insulator strip 12 in the casing 11 the inside flanges 123 of the insulator strip 12 define with the bottom walls 113 of the casing 11 a positioning space 14. The metal conducting strips 13 are bilaterally inserted into the insulator strip 12 within the casing 11, and respectively retained between the flat top wall 121 and the inside flanges 123. The flat top wall 121 of the insulator strip 12 has two longitudinally extended locating grooves 1211 for the positioning of the metal conducting strips 13. Because the metal conducting strips 13 are respectively engaged into the locating grooves 1211 and retained between the flat top wall 121 and the inside flanges 123 inside the insulator strip 12, they are well insulated from the metal casing 11. Because the casing 11 is made of metal, it has high bending strength sufficient for holding a large number of light fixtures.

Figure 5:
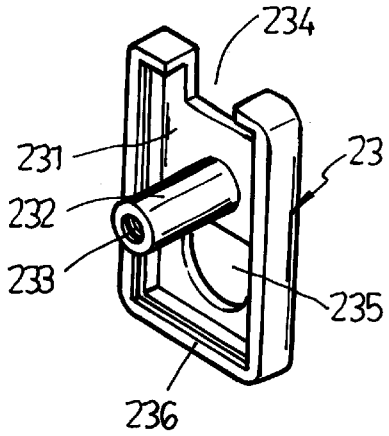
FIG. 5 is a perspective view of the third shell of the adapter according to the present invention.
Figure 6:
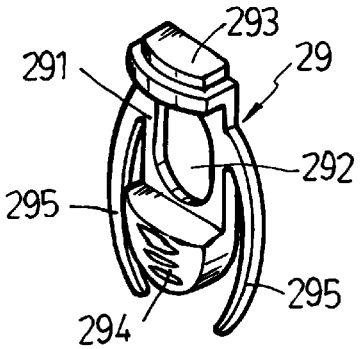
FIG. 6 is a perspective view of the latch of the adapter according to the present invention.

Referring to FIGS. 5 and 6 and FIGS. from 1 through 3 again, the adapter 2 is comprised of a first shell 21, a second shell 22, a third shell 23, two electric wires 24, two contacts 25, a rivet support 26, a bracket 27, a rivet 28, and a latch 29. The rivet 28 is inserted through a hole at the bracket 27 and a hole at the rivet support 26, and then hammered down to fix the bracket 27 to the rivet support 26 at the bottom side.

Figure 2:
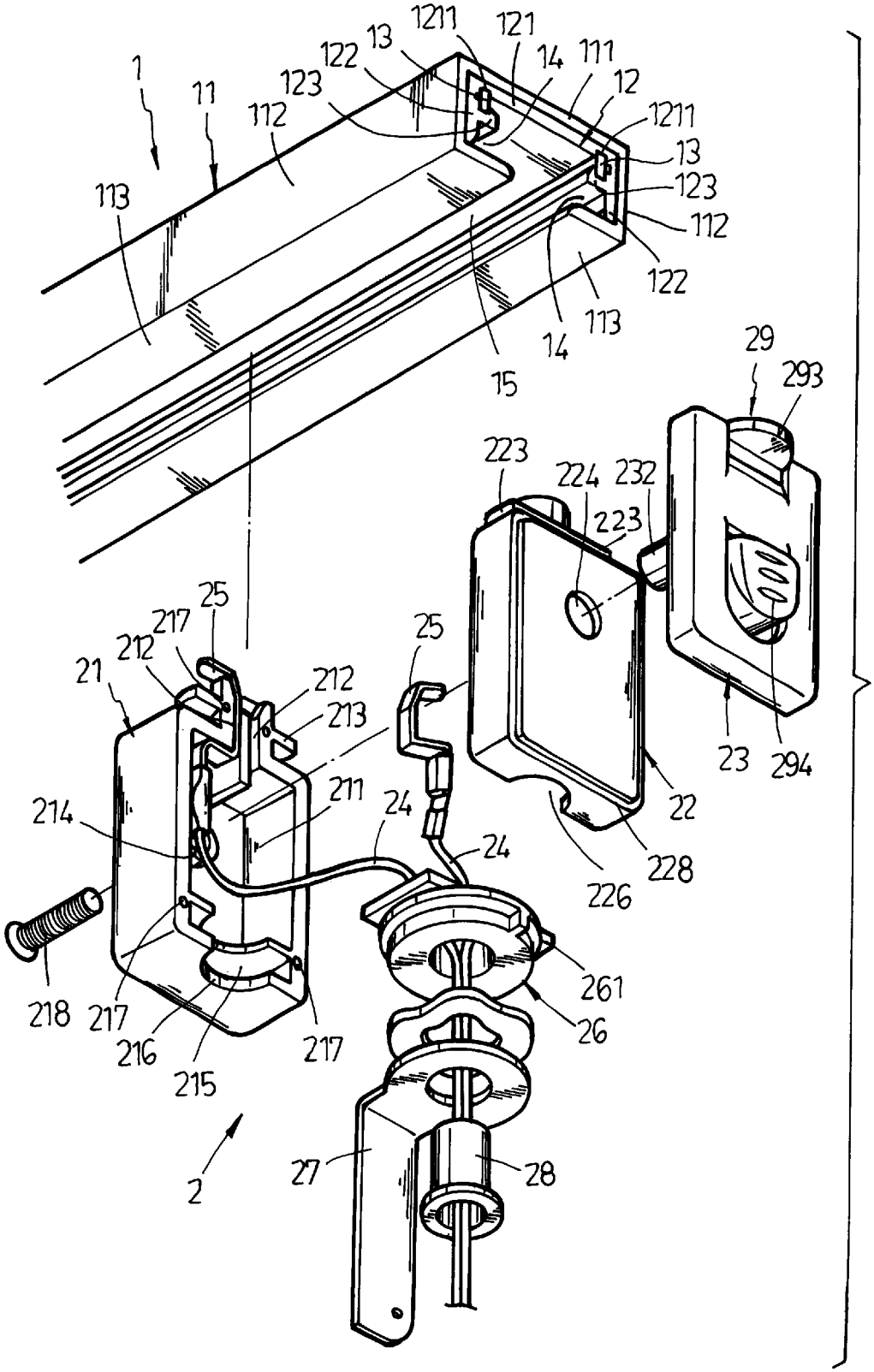
FIG. 2 is an exploded view of the adapter and track arrangement shown in FIG. 1.
Figure 3:
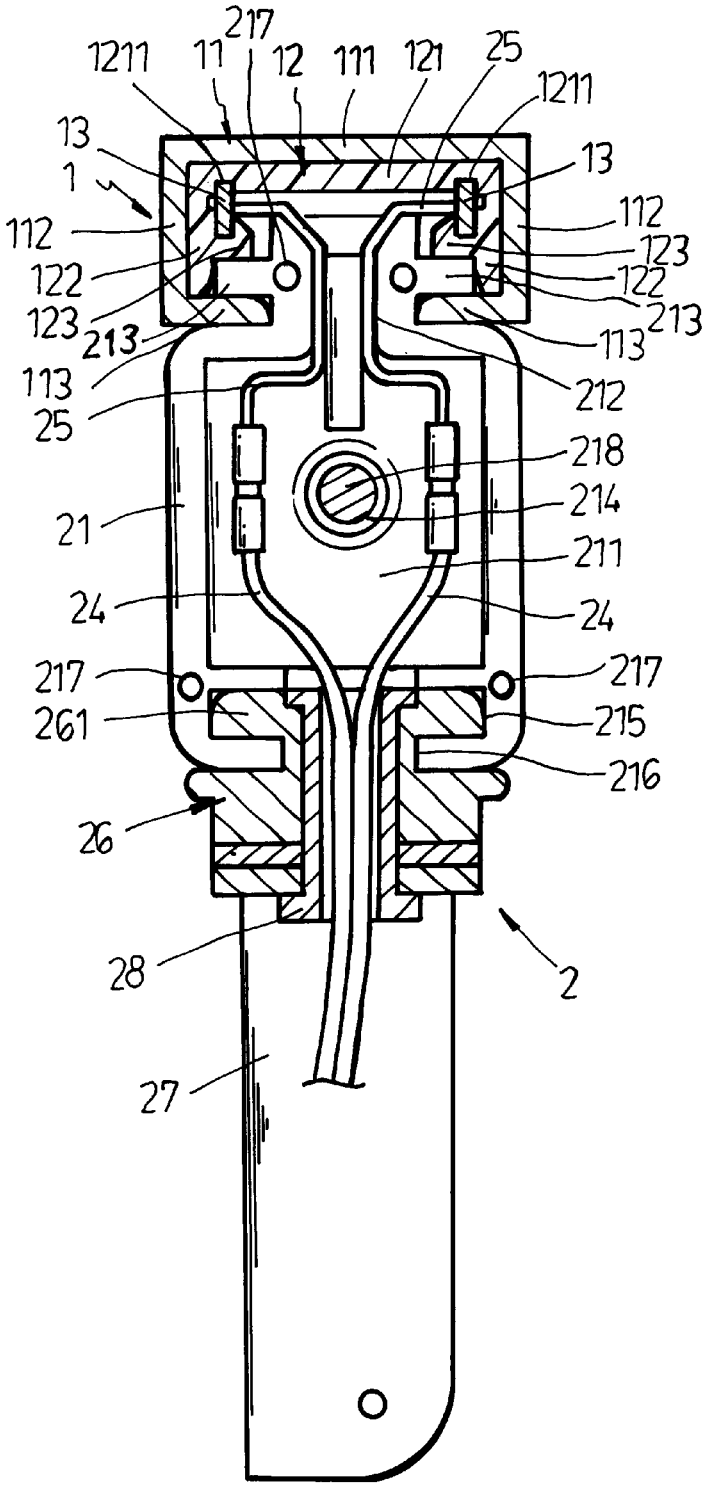
FIG. 3 is a sectional view in an enlarged scale taken along line 3—3 of FIG. 1.
Figure 4:
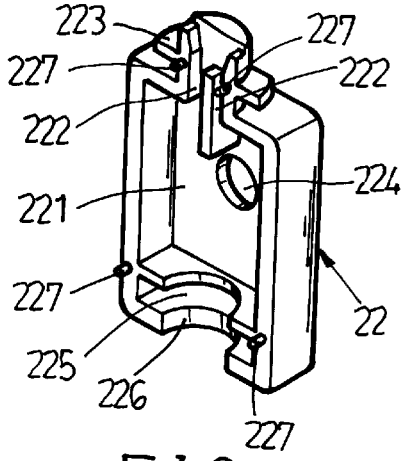
FIG. 4 is a perspective view of the second shell of the adapter according to the present invention.

Referring to FIGS. from 2 through 4 again, the first shell 21 and the second shell 22 are symmetrical, each comprising a recessed receiving chamber 211 or 221, which receives the wires 24 and the contacts 25, two top locating grooves 212 or 222, which receive the contacts 25, a bottom hole 216 or 226, which receives a part of the rivet support 26, a positioning slot 215 or 225 which receives a respective locating flange 261 from the rivet support 26, enabling the rivet support 26 to be secured to the first and second shells 21 and 22, a coupling block 213 or 223, which is inserted through the gap 15 between the bottom walls 113 of the metal casing 11 into the track 1 and then retained to the inside of the positioning space 14 in the track 1 upon a 90° angle rotation of the first and second shells 21 and 22, enabling the contacts 25 to be maintained in close contact with the metal conducting strips 13 respectively. Because each metal conducting strip 13 has a big flat contact area for the contact of the corresponding contact 25, positive electric contact is achieved between each metal conducting strip 13 and the corresponding contact 25. Further, the first shell 21 comprises a plurality of pin holes 217, and the second shell 22 comprises a plurality of pins 227 respectively press-fitted into the pin holes 217. The second shell 22 further comprises a peripheral coupling groove 228 at its back side for the positioning of the third shell 23 (see FIG. 2).

Figure 7:
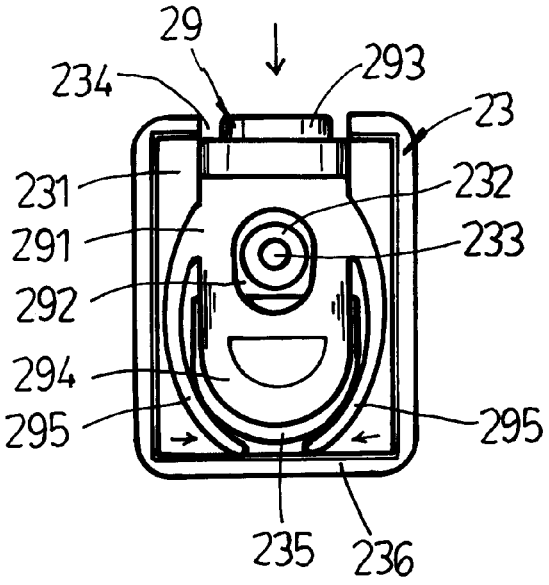
FIG. 7 is a schematic drawing showing the latch moved to the unlocking position according to the present invention.
Figure 8:
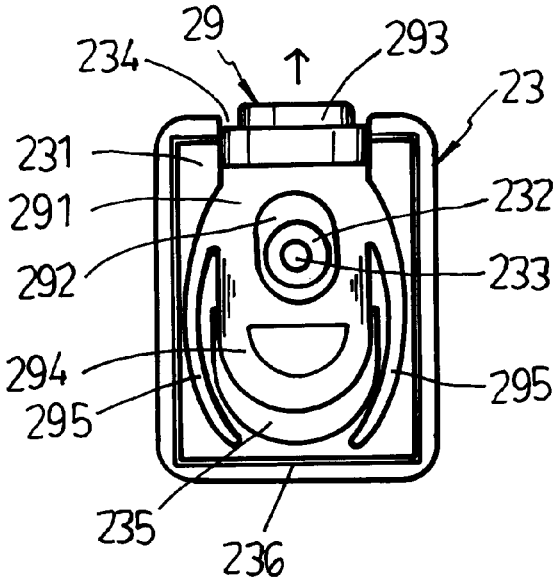
FIG. 8 is a schematic drawing showing the latch moved to the locking position according to the present invention.

Referring to Figures from 5 through 8 and FIGS. 1 and 2 again, the third shell 23 comprises a peripheral coupling flange 236 engaged into the peripheral coupling groove 228 at the second shell 22, a recessed receiving chamber 231, a mounting shaft 232 perpendicularly raised from an inside wall thereof on the middle, a top notch 234, and an opening 235. The latch 29 comprises a body 291, a stop flange 293 at the top side of the body 291, a oblong hole 292 on the body 291 in the middle, a press knob 294 formed integral with the bottom side of the body 291, and two smoothly curved spring arms 295 downwardly inwardly raised from two opposite lateral sides of the body 291. The recessed receiving chamber 231 of the third shell 23 receives the latch 29. The oblong hole 292 of the latch 29 receives the mounting shaft 232 of the third shell 23. The top notch 234 of the third shell 23 receives the stop flange 293 of the latch 29. The opening 235 of the third shell 23 receives the press knob 294 of the latch 29. When the user presses down the press knob 294 with the finger, the spring arms 295 are stopped against the third shell 23 and compressed inwards (see FIG. 7). When the finger is released from the press knob 294, the latch 29 springs from the compressed position (see FIG. 8). When the latch 29 springs from the compressed position, the stop flange 293 is forced into the gap 15 in the track 1 to lock the adapter 2. When the latch 29 is depressed and moved downwards, the adapter 2 is unlocked, and allowed to be rotated through 90° and disconnected from the track 1.

Referring to FIGS. from 2 through 5 again, the mounting shaft 232 is inserted through a circular through hole 224 at the second shell 2, and a screw 218 is inserted through a circular through hole 214 at the first shell 21 and threaded into an axially extended screw hole 233 at the mounting shaft 232 to securely fasten the first shell 21, the second shell 22 and the third shell 23 together. Because the latch 29 is received in the recessed receiving chamber 231 in the third shell 23, it is separated from the wires 24 and the contacts 25 by the second shell 22.

Figure 9:
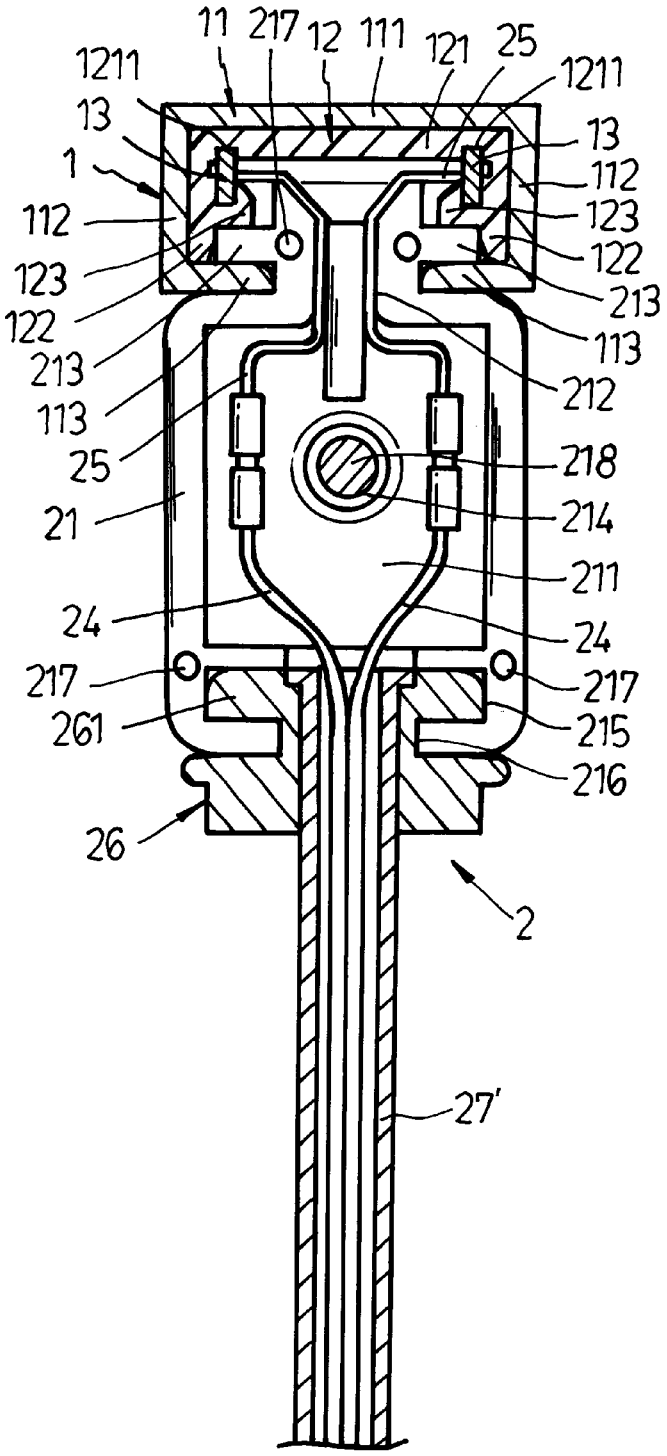
FIG. 9 is a sectional view of an alternate form of the present invention.

Referring to FIG. 9, a hanging tube 27' is used instead of the aforesaid bracket 27 and rivet 28. The top end of the hanging tube 27' is inserted through the rivet support 26 and hammered down to form a head, and the bottom end of the hanging tube 27' is provided for hanging lighting fixtures.

It is to be understood that the drawings are designed for purposes of illustration only, and are not intended as a definition and limits of the scope of the invention disclosed

What is claimed is:

1. An adapter and track arrangement comprising a track, and an adapter coupled to and movable along said track for holding lighting fixtures, wherein:

said track comprises:

an elongated metal casing having a first flat top wall, a first side wall extending downwardly from each opposite lateral side edge of the first flat top wall, and first bottom walls extending inwardly toward each other from the side walls, the first bottom walls spaced apart to form a gap extending alone a length of the elongated metal casing; an insulator strip mounted within said metal casing, and having a second flat top wall adjacent the first flat top wall, a second side wall extending from each opposite lateral side edges of the second flat top wall, and two flanges extending inwardly from the second side walls toward each other, the flanges located between the second flat top wall and the first bottom walls so as to form a positioning space with the first bottom walls; and two metal conducting strip each mounted adjacent to one of the second side walls within said insulator strip between one of the flanges and the second flat top wall and insulated from said metal casing by said insulator strip, and wherein:

said adapter comprises:

first and second shells fastened together, the first and second shells forming a first receiving chamber so as to enclose electrical wires connected to two electrical contacts extending exteriorly of the first and second shells, the first and second shells having a top coupling block configured to be removably inserted into the positioning space through the gap formed by the first bottom walls when oriented in a first position and to be non-removable from the positioning space through the gap when the first and second shells are rotated to a second position in which the electrical contacts are each in contact with one of the metal conducting strips; a third shell attached to an exterior of one of said first and second shells, said third shell forming a second recessed receiving chamber separate from the first recessed receiving chamber, a top notch, and a back opening; and a latch movably received in the second recessed receiving chamber in said third shell, said latch comprising a body received in the second recessed receiving changer so as to be substantially enclosed by said third shell, a stop flange extending from said body and through the top notch so as to be located outside of said third shell, two spring arms located within the third shell and extending from two opposite sides of the body, and, a press knob formed integrally with said body at a bottom side and protruding out of said third shell through the back opening in said third shell whereby the springs act on the third shell to bias the body toward a locking position in which the stop flange enters the gap in the metal case to prevent rotation of the first and second shells from the second position, the body being moved to a release position by movement of the press knob relative to the third shell to remove the stop block from the gap thereby enabling the first and second shells to be rotated to the first position.

2. The adapter and track arrangement of claim 1 wherein said spring arms are formed integrally with said body and extend downwardly from two opposite sides of said body, each spring arm having an arcuate configuration.

* * * * *